US005626684A

United States Patent [19]

Rodarte et al.

[11] Patent Number: 5,626,684

[45] Date of Patent: May 6, 1997

[54] METHOD AND APPARATUS FOR SEWAGE SURCHARGE DISSIPATION

[76] Inventors: Frank Rodarte, 337 Sunpark La., San Jose, Calif. 95136; Albert Nodal, 1395 Sherman St., San Jose, Calif. 95110

[21] Appl. No.: 621,197

[22] Filed: Mar. 21, 1996

Related U.S. Application Data

[63] Continuation of Ser. No. 378,546, Jan. 26, 1995, abandoned.

[51] Int. Cl.[6] ..... B08B 3/02; B08B 9/06

[52] U.S. Cl. ..... 134/22.12; 134/167 C

[58] Field of Search ..... 134/167 C, 168 C, 134/22.12; 166/185, 187; 15/104.31

[56] References Cited

U.S. PATENT DOCUMENTS

| | | | |
|---|---|---|---|
| 2,568,347 | 9/1951 | Lundelius | 134/167 C X |
| 3,080,265 | 3/1963 | Maasberg | 134/167 C X |
| 3,165,109 | 1/1965 | Hammelmann | 134/167 C |
| 3,497,899 | 3/1970 | Caperton | 15/104.31 |
| 3,535,161 | 10/1970 | Gutrich | 134/167 C X |
| 3,600,225 | 8/1971 | Parmelee | 134/22.12 X |
| 3,635,230 | 1/1972 | Kirschke | 134/168 C |
| 4,257,139 | 3/1981 | Yeo | 134/167 C X |
| 4,516,286 | 5/1985 | Crane | 15/104.12 |
| 4,766,631 | 8/1988 | Crane et al. | 15/104.12 |
| 4,773,115 | 9/1988 | Smith | 15/104.12 |
| 4,909,325 | 3/1990 | Hopmann | 134/167 C X |
| 5,068,940 | 12/1991 | Sheppard et al. | 15/104.31 |
| 5,129,957 | 7/1992 | Sheppard et al. | 134/22.22 |
| 5,226,207 | 7/1993 | Elzaurdia | 15/104.31 |
| 5,329,662 | 7/1994 | Salecker | 15/104.31 |
| 5,336,333 | 8/1994 | Sheppard et al. | 134/22.11 |
| 5,341,539 | 8/1994 | Sheppard et al. | 15/302 |

FOREIGN PATENT DOCUMENTS

| | | | |
|---|---|---|---|
| 131276 | 1/1985 | European Pat. Off. | 134/22.12 |
| 34566 | 3/1977 | Japan | 134/168 C |

*Primary Examiner*—Philip R. Coe
*Attorney, Agent, or Firm*—Donald E. Schreiber

[57] ABSTRACT

A method and apparatus for dissipating surcharge waste material clogging manholes includes a sewage surcharge dissipation head. The sewage surcharge dissipation head is connected through a high pressure hose to a source of high pressure water. The sewage surcharge dissipation head is lowered into a clogged manhole, and high pressure water is pumped through the high pressure hose to the sewage surcharge dissipation head. The high pressure water exits the sewage surcharge dissipation head through multiple water jet nozzles positioned around the circumference of the head and set at 35 degrees to the longitudinal axis of the head. The resultant water jet streams cut through, stir and dilute the surcharge clogging the manhole. The sewage surcharge dissipation head includes a means for connecting a pole to control the position and motion of the sewage surcharge dissipation head. An alternative embodiment of the invention also includes a length of pipe connecting the sewage surcharge dissipation head to the high pressure hose to provide additional stability and control of the sewage surcharge dissipation head.

4 Claims, 3 Drawing Sheets

METHOD AND APPARATUS FOR SEWAGE SURCHARGE DISSIPATION

CROSS-REFERENCE TO RELATED APPLICATION

This is a divisional of application Ser. No. 08/378,546 filed on Jan. 26, 1995, now abandoned.

BACKGROUND OF THE INVENTION

1. Field of the Invention

The apparatus and method of the present invention relate generally to the field of unclogging clogged sewer systems and, more particularly, to unclogging surcharged sewage manholes. More particularly, this invention relates to a method and apparatus used to break down and dissipate surcharge waste material clogging manholes.

2. Description of the Prior Art

Sewer systems include sewer pipes and manholes. In the context of the present invention, sewer pipes typically include six inch diameter pipes that transport liquid and solid waste materials from residential, commercial, industrial and other waste producers. The sewer pipes are typically placed underground. Sewer pipes are known to become clogged from the infiltration of sand, greasy materials, sticks, stones, tree roots, and the buildup of other materials settling out of the waste stream.

Manholes are typically 23 inch diameter pipes that extend from ground level down to the sewer pipes and provide access to the sewer pipes, including access to unclog the sewer pipes when the sewer pipes become clogged. The manholes are typically spaced at 350 foot intervals along the sewer pipes. When a sewer pipe becomes clogged, the liquid and solid waste materials in the sewer pipe fill the sewer pipe upstream of the clogged location, and, as the sewer pipe becomes filled, the liquid and solid waste materials rise in manholes upstream of the clogged location in the sewer pipe. Furthermore, when a sewer pipe becomes clogged, resulting in liquid and solid waste rising into a manhole, the liquid and solid waste in a manhole can thicken and solidify, thereby forming a plug in the manhole. The waste material filling a manhole is know as surcharge.

It is known that when a clogged sewer pipe results in one or more manholes becoming surcharged, the surcharge in the manholes must be liquefied before the sewer pipe is unclogged. This allows the waste materials in the surcharged manholes to flow unimpeded through the sewer pipe when the sewer pipe is unclogged. If surcharged manholes were unclogged after the sewer pipe is unclogged, then, when the waste materials in the manholes are broken down, chunks in the clogged manhole could fall into the sewer pipe and re-clog the sewer pipe.

It is normally best to unclog a clogged sewer pipe from the first dry manhole downstream of the clogging obstruction. This allows a clear manhole from which to work and uses the flushing effect of the waste-water flow to clear the pipe. However, roots infiltrating sewer pipes tend to grow in a downstream direction. When roots are suspected as the major cause of a clogged sewer pipe, there can be an advantage to unclogging the sewer pipe from an upstream manhole because the large tap root can be more easily reached from the upstream side, eliminating the necessity of working through all the fine feeder roots. This situation also necessitates the dissipation of the surcharge in upstream manholes before unclogging the sewer pipe. After the surcharge is dissipated, the surcharge is removed from the manhole by means such as pumping or suction, thereby allowing access to unclog the clogged sewer pipe.

It is known in the prior art to provide devices of various designs to clean and unclog sewer pipes. Such devices include a device mounted on skids and pushed through the sewer using a hydraulic motor, using high pressure water for rotating and cutting to clean the sewer pipe. This is disclosed in U.S. Pat. No. 4,766,631, entitled "Sewer Pipeline Hydraulic Root Cutter Apparatus" that issued Aug. 30, 1988 on an application filed Sep. 1, 1987 in the name of Patrick R. Crane and Donald J. Bell, and U.S. Pat. No. 4,516,286, entitled "Sewer Pipeline Cleaning Apparatus" that issued May 14, 1985 on an application filed Jun. 6, 1983 in the name of Patrick Crane. It is also known to provide rotating brushes or cutters driven by an electric motor for moving through a pipe for cleaning. This is disclosed in U.S. Pat. No. 4,773,115, entitled "Sewer Cleaning Device" that issued Sep. 27, 1988 on an application filed Oct. 7, 1986 in the name of Robert C. Smith. It is also known to provide a small electric motor mounting a grapple hook, cutter, or cleaner, with the electric motor pushed through the sewer by a rod, snake or flat bar tape. This is disclosed in U.S. Pat. No. 5,226,207, entitled "Sewer Unclogger" that issued Jul. 13, 1993 on an application filed Dec. 20, 1991 in the name of William Elzaurdia. It is also known to provide a small pneumatically driven motor mounting a grapple hook, cutter, or cleaner, with the pneumatically driven motor pushed through the sewer by a rod, snake or flat bar tape. This is also disclosed in U.S. Pat. No. 5,226,207. It is also known to provide a grapple hook or cutter or other tool connected to a distal or leading end of a snake or rod wherein the snake or rod is connected to a rotation source outside of the pipe. It is also known to provide a bullet-shaped cleaning head with rearward facing water jet nozzles. Water under high pressure, such as 2000 pounds per square inch (psi), exits the rearward facing nozzles to propel the cleaning head forward to break up obstructions in the sewer pipe. The high pressure water spray out of the rearward facing nozzles also serves to wash solid material from the walls of the sewer pipe. This is illustrated in several method and apparatus patents granted on applications filed in the names of Sheron R. Sheppard and Henry B. Polston. These patents include: U.S. Pat. No. 5,341,539, entitled "Apparatus for Cleaning Waste Collection System" that issued Aug. 30, 1994 on an application filed Dec. 2, 1991; U.S. Pat. No. 5,336,333, entitled "Method for Cleaning Waste Collection Systems" that issued Aug. 9, 1994 on an application filed Dec. 2, 1991; U.S. Pat. No. 5,129,957, entitled "Method for Cleaning Sewers" that issued Jul. 14, 1992 on an application filed Aug. 19, 1991; and U.S. Pat. No. 5,068,940, entitled "Apparatus for Cleaning Sewers" that issued Dec. 3, 1991 on an application filed Nov. 1, 1990.

Presently, a surcharge in a clogged manhole is liquefied by adding a large amount of water, e.g., 800 to 1000 gallons, to the solidified sewage while agitating the water-sewage mixture with a rod or pole. This process of manually stirring a manhole's surcharge usually takes 45 minutes per manhole, and the sewage in all surcharged manholes must be liquefied before clearing the sewer line blockage. After the sewage in all surcharged manholes has been liquefied, the sewer pipe is unclogged using a device such as one of the sewer pipe cleaning and unclogging devices listed above.

SUMMARY OF THE INVENTION

An object of the present invention is to provide a means to dissipate the surcharge in clogged manholes efficiently.

Another object of the present invention is to provide a means to dissipate the surcharge in clogged manholes using less water.

Another object of the present invention is to provide a means to dissipate the surcharge in clogged manholes faster.

Another object of the present invention is to dissipate the surcharge in clogged manholes by means of a sewage surcharge dissipation head having multiple water jet nozzles.

In contrast to the prior methods of dissipating the surcharge in clogged manholes, the present invention is designed to reduce the time it takes to unclog a manhole, thereby increasing the number of manholes that can be unclogged per day, and thereby reducing the time it takes to unclog a clogged sewer system. The present invention is also designed to operate using less water to unclog a manhole. The apparatus and method of the present invention have reduced the cost and improved the efficiency of unclogging manholes by using a combination of apparatus and techniques heretofore unknown in this art.

The apparatus and method of the present invention is directed to unclogging manholes using a sewage surcharge dissipation head to cut through, stir and dilute the surcharge in the clogged manholes. The invention includes (1) a source of high pressure water including a high pressure hose; (2) a new and unobvious sewage surcharge dissipation head; (3) means to lower the end of the high pressure hose with the sewage surcharge dissipation head into a manhole and to control the position and motion of the end of the high pressure hose with the sewage surcharge dissipation head to cut through, stir and dilute the surcharge clogging the manhole.

The high pressure water source is typically a truck-mounted pump connected to a water tank. The high pressure water source also includes a high pressure water hose with one end attached to the pump. Attached to the other end of the high pressure hose is the novel sewage surcharge dissipation head. The sewage surcharge dissipation head has water jet nozzles piercing through the cylindrical walls of the sewage surcharge dissipation head, with such water jet nozzles set at an angle relative to the longitudinal axis of the sewage surcharge dissipation head which has been found to maximize the effectiveness of the resultant high pressure water stream in cutting through, stirring and diluting the surcharge in clogged manholes.

In contrast to prior art methods of sewer surcharge dissipation, the present invention's sewage surcharge dissipation head cuts through, stirs and dilutes the surcharge through the action of multiple high pressure water streams formed by the water jet nozzles of the sewage surcharge dissipation head. With the improved action of the multiple high pressure water streams, the method and apparatus of the present invention proves effective using water pressures of only 1000 pounds per square inch in order to break down and dissipate the surcharge in clogged manholes.

Prior art sewer surcharge dissipation methods typically take 45 minutes to an hour, and consume 800 to 1000 gallons of water, to manually liquefy the solidified surcharge and unclog a manhole. The method and apparatus of the present invention typically takes only 15 to 20 minutes, and consumes approximately 200 gallons of water to dissipate the surcharge and unclog a clogged manhole.

Several sewer pipe cleaning methods and devices, such as those illustrated in U.S. Pat. Nos. 5,341,539, 5,336,333, 5,129,957, 5,068,940, listed above, use high pressure water systems in conjunction with a sewer pipe cleaning head. The present invention therefore has the additional advantage of being able to use the same source of high pressure water as that used by the sewer pipe cleaning device, and adjusted to operate at a lower pressure.

These and other features, objects and advantages will be understood or apparent to those of ordinary skill in the art from the following detailed description of the preferred embodiment of the invention as illustrated in the various drawing figures.

DETAILED DESCRIPTION OF THE PREFERRED EMBODIMENT

Figure 1:
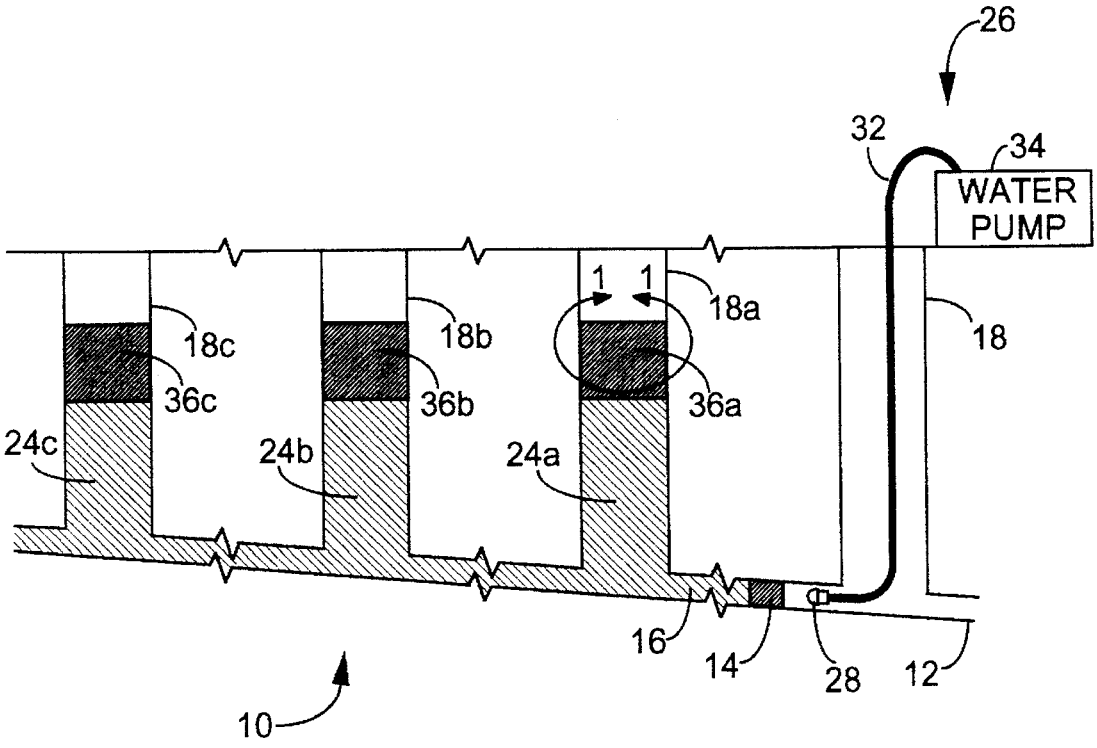
FIG. 1 is a cross-sectional elevational view illustrating a section of a clogged sewer system.

Referring to the drawings, FIG. 1 depicts a section of a clogged sewer system referred to by the general reference character 10. The sewer system 10 includes a 6 inch diameter sewer pipe 12. The sewer pipe 12 has become clogged by an obstruction 14. Sewage 16 upstream of the obstruction 14 has filled the sewer pipe 12 and also risen in 23 inch diameter manholes 18*a*, 18*b* and 18*c* connected to the sewer pipe 12 upstream of the obstruction 14. Sewage 16 has risen in the upstream manholes 18*a*, 18*b* and 18*c* forming surcharge 24*a*, 24*b* and 24*c*, with a portion of the surcharge solidifying 36*a*, 36*b* and 36*c*, thereby clogging the upstream manholes 18*a*, 18*b* and 18*c*. A 23 inch diameter manhole 18 connected to the sewer pipe 12 downstream of the obstruction 14 is not filled with surcharge.

FIG. 1 also depicts a conventional sewer pipe cleaning system 26. The sewer pipe cleaning system 26 includes a high pressure water pump 34, a high pressure hose 32, and a high pressure sewer pipe cleaning head 28. Other components of the conventional sewer pipe cleaning system such as the water source are not illustrated in any of the FIGs.

Figure 2:
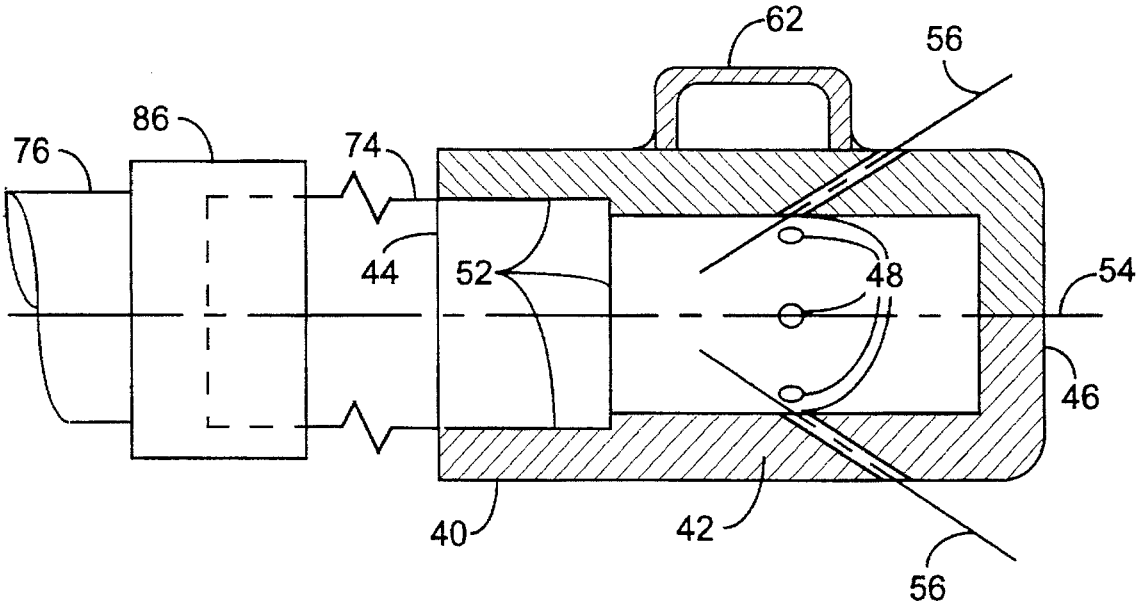
FIG. 2 is a mechanical drawing of a sewage surcharge dissipation head, with one end of a pipe connected to the sewage surcharge dissipation head, and the other end of the pipe connected to a high pressure hose.

FIG. 2 depicts a sewage surcharge dissipation head referred to by the general reference character 40. The sewage surcharge dissipation head 40 has a cylindrical wall 42, an open end 44, a closed end 46, and a longitudinal axis 54 which extends through the open end 44 and closed end 46. The sewage surcharge dissipation head 40 is approximately 3½ inches long and approximately 2 inches in diameter.

Water jet nozzles 48 pierce through the cylindrical wall 42 of the sewage surcharge dissipation head 40. The water jet nozzles 48 are evenly spaced around the circumference of the cylindrical wall 42 of the sewage surcharge dissipation head 40, and are positioned equidistant from the closed end 46 of the sewage surcharge dissipation head 40. The water jet nozzles 48 have longitudinal axes 56. The number of water jet nozzles 48, the size of the water jet nozzles 48, and the angle of the longitudinal axes 56 of the water jet nozzles 48 relative to the longitudinal axis 54 of the sewage surcharge dissipation head 40 are all selected to maximize the effectiveness of the sewage surcharge dissipation head 40 to cut through, stir and dilute a solidified sewage surcharge 36*a*, 36*b*, 36*c* (FIG. 1). In the preferred embodiment of the present invention, there are eight water jet nozzles 48 exiting the cylindrical wall 42 approximately 0.9 inches from the closed end 46 of the sewage surcharge dissipation head 40, with each water jet nozzle 48 having a diameter of approximately 0.1 inches, and the angle between the longitudinal axes 56 of the water jet nozzles 48 relative to the longitudinal axis 54 of the sewage surcharge dissipation head 40 is preferably 35 degrees.

The open end 44 of the sewage surcharge dissipation head 40 provides a connecting means 52 for connecting the sewage surcharge dissipation head 40 to a high pressure hose 76 (illustrated in FIG. 3) or to an optional pipe 74 (also illustrated in FIG. 3) interposed between the sewage surcharge dissipation head 40 and the high pressure hose 76. The connecting means 52 may be a conventional threaded coupling, a quick-disconnect, or any other means suitable for connecting high pressure nozzles to high pressure hoses. The sewage surcharge dissipation head 40 also includes means for attaching the sewage surcharge dissipation head 40 to a pole. In the preferred embodiment of the present invention, the attaching means is a u-shaped handle 62 attached to the cylindrical wall 42 of the sewage surcharge dissipation head 40.

FIG. 2 depicts the open end 44 of the sewage surcharge dissipation head 40 with a pipe 74 interposed between the sewage surcharge dissipation head 40 and the high pressure hose 76. With the optional pipe 74 interposed between the sewage surcharge dissipation head 40 and the high pressure hose 76, the connecting means 52 may include welding the pipe 74 to the sewage surcharge dissipation head 40, or conventional threaded coupling, a quick-disconnect, or any other means suitable for connecting high pressure nozzles to pipes. The pipe 74 is connected to the high pressure hose 76 using a hose-connecting means 86, which may also be a conventional threaded coupling, a quick-disconnect, or other means suitable for connecting pipes to high pressure hoses.

Figure 3:
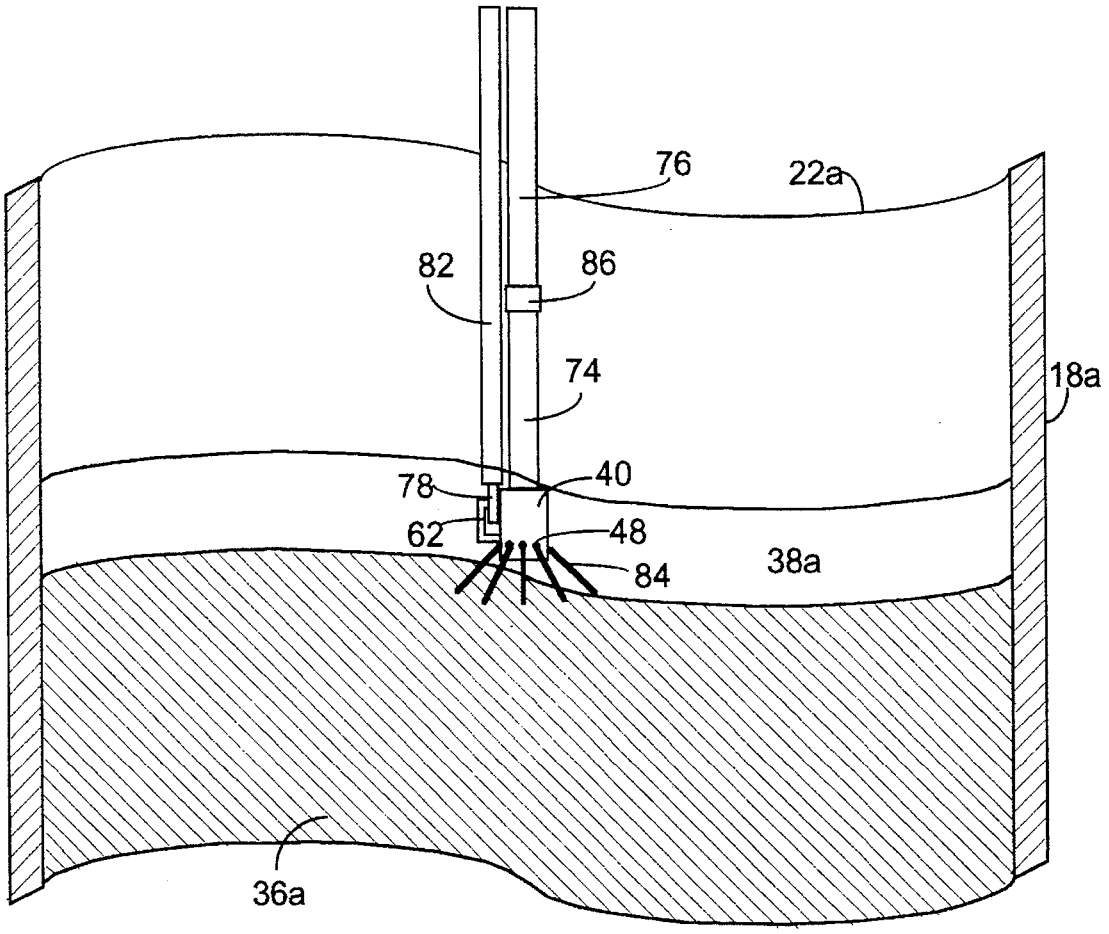
FIG. 3 is a cross-sectional elevational view of a section of a sewer system manhole taken along the line 1—1 in FIG. 1.

FIG. 3 depicts a section of a manhole 18*a* in a clogged sewer system 10 depicted in FIG. 1. The sewage surcharge dissipation head 40 has been lowered into the manhole 18*a* and is shown just above the level of the solidified surcharge 36*a*. The sewage surcharge dissipation head 40 is connected to the high pressure pump 34, illustrated in FIG. 1, by a high pressure hose 76. In this embodiment, an optional length of pipe 74, is inserted between the sewage surcharge dissipation head 40 and the high pressure hose 76 to provide additional stability and control of the positioning of the sewage surcharge dissipation head 40. A pole 82 is attached to the sewage surcharge dissipation head 40 by a pole-connecting means 78, which may be a snap hook, hasp shackle, or the like, connected to the u-shaped handle 62. The pole 82 provides the primary means of controlling the position and motion of the sewage surcharge dissipation head 40. Water jets 84 exit the sewage surcharge dissipation head 40 through the water jet nozzles 48.

In operation, a pool of water 38*a* is established above the surcharge 36*a* by pouring water into the manhole 18*a* using a low pressure hose connected to a water source (not illustrated in any of the FIGs.). The pool of water 38*a* above the surcharge 36*a* has a depth at least equivalent to approximately the length of the sewage surcharge dissipation head 40. The pool of water 38*a* helps to prevent the water jets 84 from being reflected off the surcharge 36*a* and wall of the manhole 18*a* up out of the manhole opening 22*a* toward the operator (not illustrated in any of the FIGs.).

The sewage surcharge dissipation head 40 is connected to the high pressure hose 76 and a pole is attached to the sewage surcharge dissipation head 40 by means of the u-shaped handle 62. The high pressure hose 76 and sewage surcharge dissipation head 40 are lowered into the clogged manhole 18*a* and the sewage surcharge dissipation head 40 is submersed in the pool of water 38*a* above the surcharge 36*a*. The source of high pressure water is activated, feeding high pressure water, preferably at a pressure of 1000 pounds per square inch, through the high pressure hose 76 to the sewage surcharge dissipation head 40. Water jets 84 exit the sewage surcharge dissipation head 40 through the water jet nozzles 48 and strike the surcharge 36*a*. The high pressure and concentrated stream of the water jets 84 cuts through the surcharge 36*a*. The sewage surcharge dissipation head 40 is moved around within the manhole 18*a* over the entire area of the surcharge 36*a* to cut through, stir and dilute the surcharge, and to wash and clean surcharge material from the walls of the manhole 18*a*. As successive levels of the surcharge 36*a* become liquefied, the sewage surcharge dissipation head 40 is lowered further into the surcharge 36*a*, continuing the cutting, stirring and diluting action until the surcharge 36*a* has been completely liquefied. The high pressure water pump 34 supplying water to the sewage surcharge dissipation head 40 may be the same as the pump supplying water to the high pressure sewer pipe cleaning head 28 adjusted to operate at a lower pressure.

Although the present invention has been described in terms of the presently preferred embodiments, it is to be understood that such disclosure is purely illustrative and is not to be interpreted as limiting. Consequently, without departing from the spirit and scope of the invention, various alterations, modifications, and/or alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention.

What is claimed is:

1. A method of liquefying a solidified sewage surcharge consisting of liquid and solid waste that rises up, thickens and solidifies within a vertically oriented sewer system manhole; the vertically oriented sewer system manhole extending from ground level down to an almost horizontally oriented sewer pipe, and being located upstream from a blockage in the almost horizontally oriented sewer pipe; the method comprising the steps of:

supplying a source of high pressure water to a sewage surcharge dissipation head;

inserting the sewage surcharge dissipation head downward into the vertically oriented manhole; and pumping said high pressure water through said sewage surcharge dissipation head, so said high pressure water exits said sewage surcharge dissipation head downward against the solidified surcharge to thereby agitate and liquefy the surcharge that is disposed within the vertically oriented sewer system manhole above the almost horizontally oriented sewer pipe.

2. The method of claim 1, wherein the step of inserting the sewage surcharge dissipation head downward into the vertically oriented manhole comprises the steps of:

attaching one end of a pole to said sewage surcharge dissipation head; and lowering said sewage surcharge dissipation head into the vertically oriented manhole.

3. The method of claim 2, wherein the sewage surcharge dissipation head directs a plurality of streams of water against the solidified surcharge.

4. The method of claim 3, wherein the streams of water exit the sewage surcharge dissipation head at an angle of 35 degrees from a longitudinal axis of said sewage surcharge dissipation head.

* * * * *